US007972255B2

(12) United States Patent
Inaba et al.

(10) Patent No.: US 7,972,255 B2
(45) Date of Patent: Jul. 5, 2011

(54) SELF-SUPPORTING BAG

(75) Inventors: Shinichi Inaba, Tokyo (JP); Yoshinori Inagawa, Tokyo (JP)

(73) Assignee: Kao Corporation, Tokyo (JP)

( * ) Notice: Subject to any disclaimer, the term of this patent is extended or adjusted under 35 U.S.C. 154(b) by 1302 days.

(21) Appl. No.: 10/532,109

(22) PCT Filed: Oct. 23, 2003

(86) PCT No.: PCT/JP03/13569

§ 371 (c)(1),
(2), (4) Date: Oct. 19, 2005

(87) PCT Pub. No.: WO2004/037673

PCT Pub. Date: May 6, 2004

(65) Prior Publication Data

US 2006/0140515 A1 Jun. 29, 2006

(30) Foreign Application Priority Data

Oct. 24, 2002 (JP) ..... 2002-310260
Nov. 21, 2002 (JP) ..... 2002-338515

(51) Int. Cl.
*B65D 30/16* (2006.01)

(52) U.S. Cl. ..... 493/267; 206/524.1; 383/104; 383/120

(58) Field of Classification Search ..... 206/524.1, 206/524.5, 524.6, 524.2, 484, 484.2, 524; 383/104, 120, 37, 32; 493/267
See application file for complete search history.

(56) References Cited

U.S. PATENT DOCUMENTS

| | | | | | |
|---|---|---|---|---|---|
| 584,556 | A * | 6/1897 | Lorenz | 383/120 |
| 3,727,803 | A * | 4/1973 | Cobb | 222/215 |
| 5,174,458 | A * | 12/1992 | Segati | 215/383 |
| 5,529,396 | A * | 6/1996 | Pryor et al. | 383/111 |
| 6,126,315 | A * | 10/2000 | Ichikawa et al. | 383/43 |
| 6,206,243 | B1 * | 3/2001 | Schneider et al. | 222/95 |
| 6,488,222 | B1 * | 12/2002 | West et al. | 242/160.4 |
| 6,715,919 | B2 * | 4/2004 | Hiraiwa et al. | 383/205 |
| 2002/0126921 | A1 | 9/2002 | Bell | |

FOREIGN PATENT DOCUMENTS

| | | |
|---|---|---|
| EP | 0 634 341 | 1/1995 |
| EP | 0 893 358 | 1/1999 |
| JP | 57-183952 | 11/1982 |
| JP | 59-193107 | 12/1984 |
| JP | 3-148451 | 6/1991 |

(Continued)

OTHER PUBLICATIONS

U.S. Appl. No. 12/935,440, filed Sep. 29, 2010, Sagara, et al.

(Continued)

*Primary Examiner* — J. Gregory Pickett
*Assistant Examiner* — King M Chu
(74) *Attorney, Agent, or Firm* — Oblon, Spivak, McClelland, Maier & Neustadt, L.L.P.

(57) ABSTRACT

The invention provides a self-supporting bag (10) in which a synthetic resin bag main body (11) constituted by a body portion (20) and a bottom portion (30) is molded preferably by a metal mold, and the entire main body (11) is set in a folded state in a step before filling the bag's main body (11), wherein the folded state of the bag's main body (11) is formed by folding the entire bottom portion (30) in parallel to the body portion (20).

18 Claims, 15 Drawing Sheets

FOREIGN PATENT DOCUMENTS

| | | | | |
|---|---|---|---|---|
| JP | 4-163124 | | 6/1992 | |
| JP | 5-46717 | | 6/1993 | |
| JP | 6-6215 | | 1/1994 | |
| JP | 6-127562 | | 5/1994 | |
| JP | 7-69357 | | 3/1995 | |
| JP | 11-130031 | | 5/1999 | |
| JP | 11-130034 | | 5/1999 | |
| JP | 11-130073 | | 5/1999 | |
| JP | 11-130074 | | 5/1999 | |
| JP | 11-130082 | | 5/1999 | |
| JP | 11-130112 | | 5/1999 | |
| JP | 11-130138 | | 5/1999 | |
| JP | 11-227801 | | 8/1999 | |
| JP | 2000-25799 | | 1/2000 | |
| JP | 2000-334814 | | 12/2000 | |
| JP | 2001-72030 | | 3/2001 | |
| JP | 2001 072030 | | 3/2001 | |
| JP | 2001072030 | * | 3/2001 | ..... 222/95 |
| JP | 2001072030 A | * | 3/2001 | ..... 222/95 |
| JP | 2001-106217 | | 4/2001 | |
| JP | 2001-114284 | | 4/2001 | |
| JP | 2001-114307 | | 4/2001 | |
| JP | 2001-315742 | | 11/2001 | |
| JP | 2001-315743 | | 11/2001 | |
| JP | 2002-104441 | | 4/2002 | |
| JP | 2002-211595 | | 7/2002 | |
| JP | 2002-284199 | | 10/2002 | |
| JP | 2003-291934 | | 10/2003 | |

OTHER PUBLICATIONS

U.S. Appl. No. 12/935,441, filed Sep. 29. 2010, Sagara, et al.

* cited by examiner (A)

(B)

(A)

(B)

(A)

(B)

(A)

(B)

(A)

(B)

(A)

(B)

(A)

(B)

(A)

(B)

(A)

(B)

SELF-SUPPORTING BAG

FIELD OF THE INVENTION

The present invention relates to a flexible self-supporting bag.

BACKGROUND OF THE INVENTION

A synthetic resin folding container described in Japanese Patent Application Laid-Open No. 3-148451 (reference document 1) is structured such that a container's main body can be folded in an empty state, a male screw is provided in an opening portion of the container's main body, and a cap is mounted to the male screw. Accordingly, even if the container's main body is folded, it is impossible to obtain a folded state in which the entire main body of the container is formed approximately in a flat shape, due to the existence of the opening portion with the male screw and the existence of the cap, such that storing such container in a flat position is difficult.

On the contrary, a self-supporting bag described in Japanese Patent No. 3077751 (reference document 2) is structured such that the bag's main body is formed by laminating synthetic resin front and back body portion sheets and a synthetic resin bottom portion sheet, so that the entire main body of the bag can be folded.

SUMMARY OF THE INVENTION

In accordance with the present invention, there is provided a self-supporting bag in which the main body of the synthetic resin bag comprises a molded body portion and a bottom portion, wherein the entire main body of the bag is set in a folded state in a step before filling the main body of the bag, wherein the folded state of the bag's main body is formed by folding the entire bottom portion in parallel to the body portion.

Further, in accordance with another embodiment of the present invention, there is also provided in the self-supporting bag as mentioned above, a pouring port formed in the bag's main body, and the self-supporting bag may be further provided with an air communication passage forming portion for allowing ambient air into the inner portion of the bag's main body, at the time of pouring its content from the pouring port formed in the bag's main body.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings and in which:

DETAILED DESCRIPTION OF THE INVENTION

Figure 1:
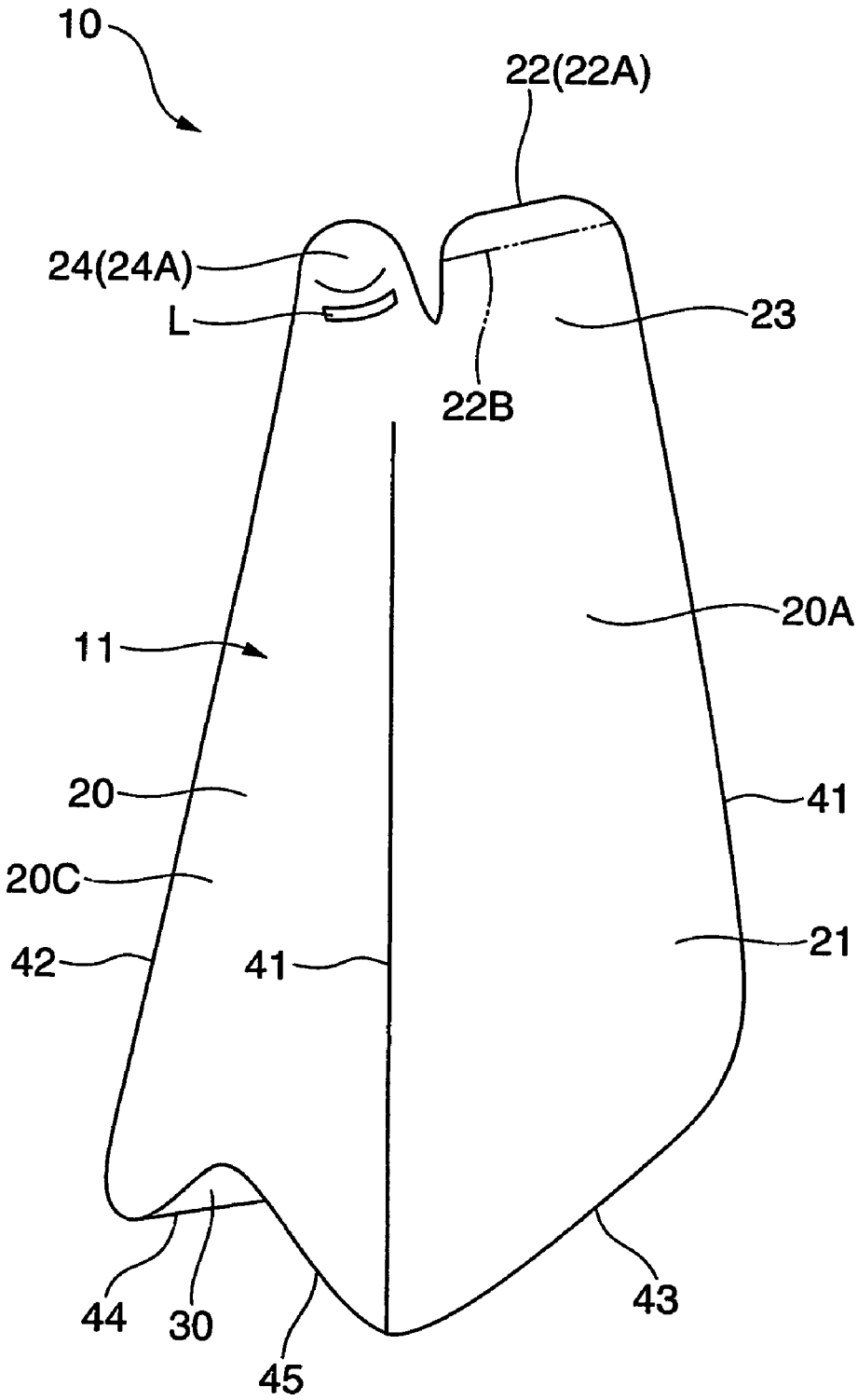
FIG. 1 is a perspective view showing a self-supporting bag in accordance with a first embodiment.

The present invention relates to an improved self-supporting bag having stable properties in the empty state wherein the entire main body of the bag may be folded, and is structured to make it easy to form a charging port. At the same time, it is intended to make manufacturing simple, improve the aesthetic external appearance of the bag's main body, stabilize the bag quality, improve the dropping strength and its ability to stably secure a pouring port.

The present invention also relates to a structure which makes it easy to support a self-supporting bag by using hands at the time of pouring its contents, and makes it hard to generate pulsation of poured liquid. Further, the present invention also reduces the residual amount of the bag's content left after pouring.

The conventional self-supporting bag mentioned above has the following problems.

(1) The bag's main body is formed by laminating the flat-shaped sheets, that is, the body portion sheet and the bottom portion sheet, which has extremely low rigidity, and its self-supporting properties deteriorate when the bag is empty. Accordingly, the bag's main body tends to bend even when a carrying device is used at the time of transporting the empty bag to be filled or the like, and its handling properties are poor.

(2) The front and back body portion sheets tend to be closely attached to each other in an overlapping portion, and when a charging or filling port fails to open during the step of peeling the front and back sheets so as to form a charging port during the filling process, such bag may be scrapped.

Further, the self-supporting bag described in the reference document 2 mentioned above is structured such that the main body of the flexible bag is formed by laminating synthetic resin front and back body portion sheets and a synthetic resin bottom portion sheet. The self-supporting bag mentioned above uses less resin in the bag's main body in comparison with a rigid bottle, and the bag's main body can be stored in a folded state prior to filling the bag's main body.

However, in the self-standing bag described in the reference document 2 mentioned above, the bag's main body has flexibility by which the volume of the bag's main body is reduced under application of atmospheric pressure at the time of pouring the contents from a pouring port formed in the bag's main body. Accordingly an air gap portion in which air replacement is necessary is not generated in the inner portion of the bag's main body, and a pulsation of poured liquid, caused by a matter that a large bubble intruding into the inner portion of the bag's main body for replacing air largely ruptures at the time of entering into the air gap portion. However, as a result of the volume of the bag's main body being reduced in correspondence to the amount of the contents to be poured, and the rigidity of the bag's main body being continuously reduced, the pouring property is extremely poor in view of the fact that the bag's main body is hard to be supported using hands. Further, in a state in which most of the content is poured out, the inner surfaces of the bag are closely attached to each other, whereby making it hard to pour the content left at the bottom of the bag.

Further, the conventional self-supporting bag has the following problems.

(a) The bag's main body is manufactured by preparing a plurality of sheets (the body portion sheet and the bottom portion sheet) and laminating them, and such manufacturing step is complex.

(b) Since the body portion of the bag's main body is structured by two-dimensionally laminating the front and back body portion sheets, a wrinkle may be generated in the body portion so as to deteriorate the aesthetic external appearance of the bag's main body, at a time when the body portion is bulged when filled.

(c) The body portion sheet and the bottom portion sheet employ a laminated film obtained by laminating an adhesive inner film for allowing lamination, and a non-adhesive outer film which is not melted and is not soiled by heat application by a heat seal bar for laminating, in contact with an outer edge of the body portion sheet via an intermediate adhesion layer. Accordingly, when a bag's content includes a surface active agent and a solvent, there is a risk that the stability of the bag quality deteriorates such that the surface active agent and the solvent permeate the intermediate adhesion layer from the inner film so as to generate peeling between the inner film and the outer film, and the like.

(d) The intersection point of lamination between the body portion sheet and the bottom portion sheet is weak when dropped and tends to crack upon impact.

(e) Since the pouring port is provided in the two-dimensional lamination portion between the front and back body portion sheets, the pouring port tends to close. In order to prevent the closure, it is necessary to insert a straw or the like in the portion between the front and back body portion sheets.

The following further describes embodiments of the present invention. The descriptions are given solely for the purpose of illustration and are not to be construed as limitations of the present invention.

First Embodiments

FIGS. 1 to 8

A self-supporting bag 10 is obtained by blow molding a synthetic resin bag main body 11 constituted by a body portion 20 and a bottom portion 30 in a three-dimensional shape (e.g. a stereoscopic shape), as shown in FIG. 1, and the entire main body 11 of the bag can be set in a folded state in a step before filling the bag's main body 11.

The bag's main body 11 has a content receiving portion 21 constituted by the body portion 20 and the bottom portion 30, and a charging or filling port forming portion 22 for forming a wide opening extending along the entire width or most of the entire width of the upper edge portion of the body portion 20, and forming a charging port 22A for filling. The entire receiving portion 21, the charging port forming portion 22 and a shoulder portion 23 is blow molded in such a manner as to smoothly connect the receiving portion 21 and the charging port forming portion 22 by the shoulder portion 23. The shoulder portion 23 is narrowed in an inverse-V shape from a side of the receiving portion 21 toward a side of the charging port forming portion 22, in a side view of the self-supporting bag 10 (in a direction along a longitudinal direction of a seal portion 22B mentioned below the charging port forming portion 22).

The bag's main body 11 is structured such that the body portion 20 is constituted by a front surface portion 20A, a back surface portion 20B and both side surface portions 20C, a ridge line portion 41 is provided in a boundary between the front surface portion 20A and both the side surface portions 20C, a ridge line portion 42 is provided in a boundary between the back surface portion 20B and both the side surface portions 20C, a ridge line portion 43 is provided in a boundary between the front surface portion 20A and the bottom portion 30, a ridge line portion 44 is provided in a boundary between the back surface portion 20B and the bottom portion 30, and a ridge line portion 45 is provided in a boundary between both the side surface portions 20C and the bottom portion 30. Further, the bag's main body 11 is provided with a ridge line portion 46 extending along a parting line of a blow molding metal mold in a center portion extending along a longitudinal direction of both the side surface portions 20C, and is provided with a ridge line portion 47 extending along the parting line of the blow molding metal mold in a center portion of the bottom portion 30.

The self-supporting bag 10 is sealed by filling from the charging port 22A, thereafter clamping the front surface portion 20A and the back surface portion 20B of the charging port forming portion 22 by a seal bar, and fusion bonding the front surface portion 20A and the back surface portion 20B by heat sealing or ultrasonic sealing or the like. Accordingly, the charging port forming portion 22 forms the seal portion 22B.

The self-supporting bag 10 may form a pouring port forming portion 24 for forming a pouring port 24A in a part of the body portion 20 close to an upper edge, at a time of blow molding, as shown in FIG. 1. The pouring port 24A is formed by cutting the pouring port forming portion 24.

Figure 2:
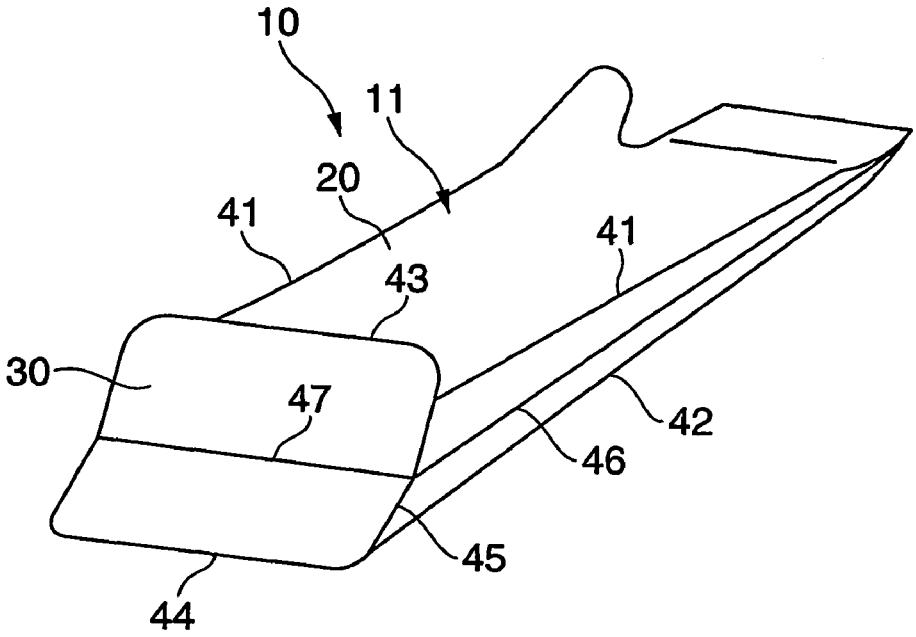
FIG. 2 is a perspective view showing a folded state of the self-supporting bag.
Figure 2:
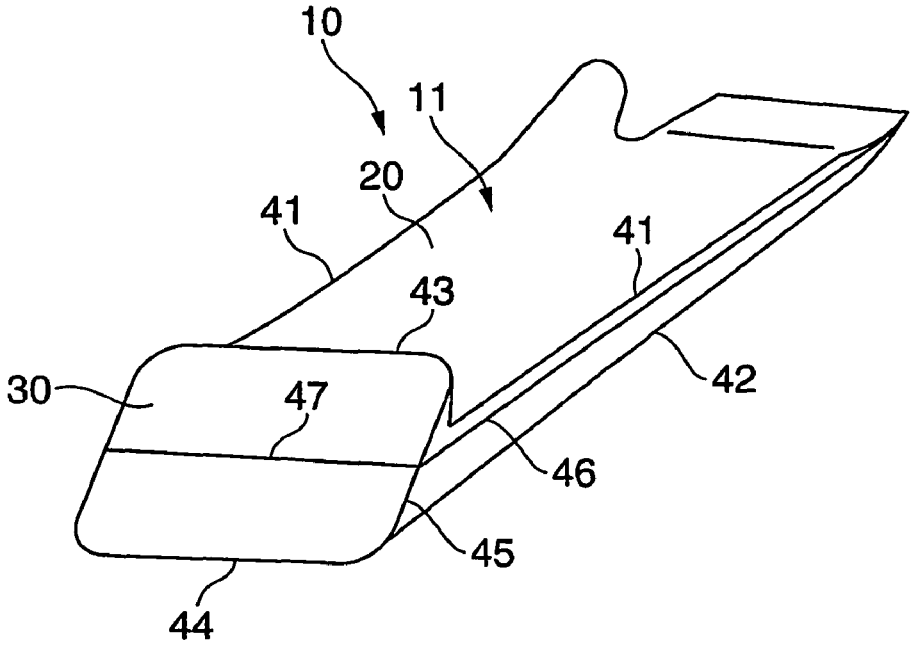
Figure 3:
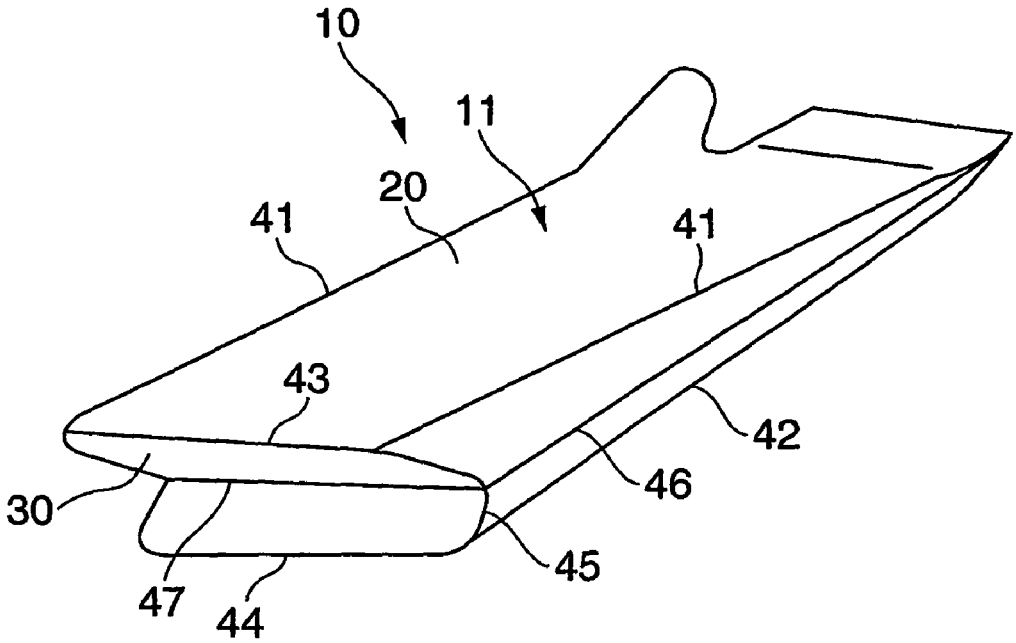
FIG. 3 is a perspective view showing the folded state of the self-supporting bag.
Figure 3:
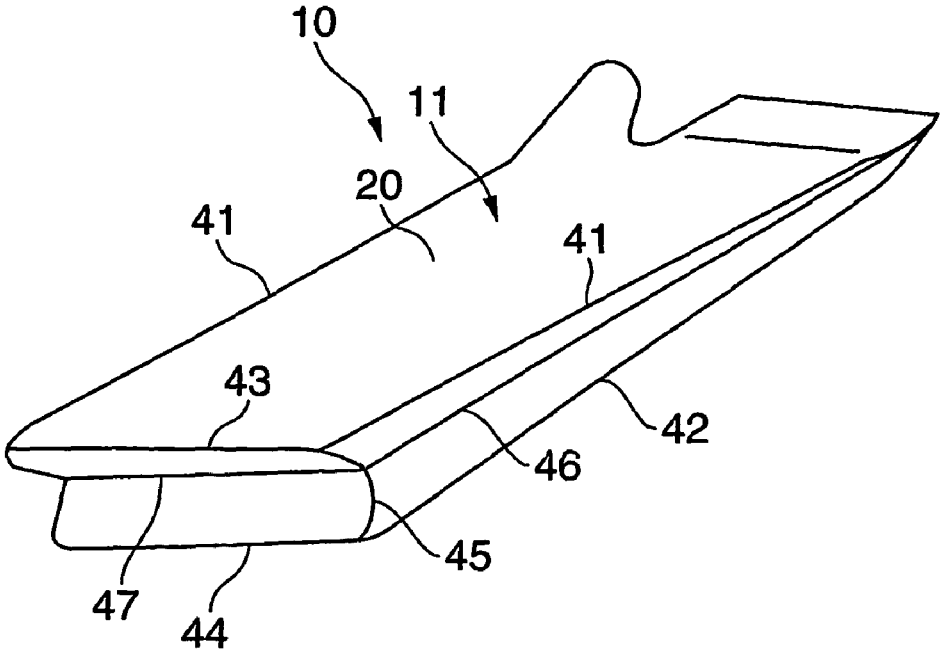
Figure 4:
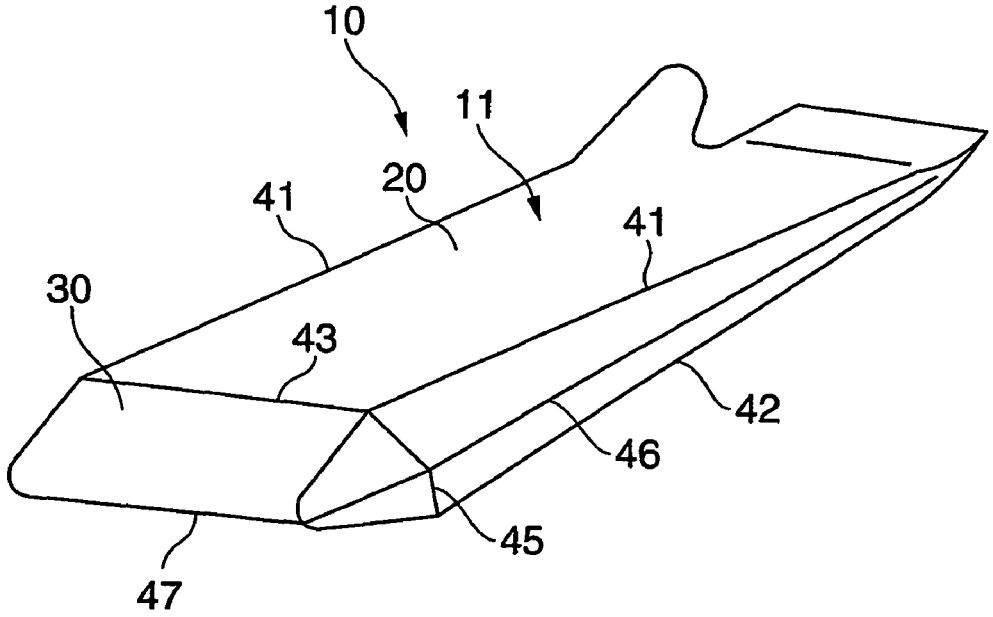
FIG. 4 is a perspective view showing the folded state of the self-supporting bag.
Figure 4:
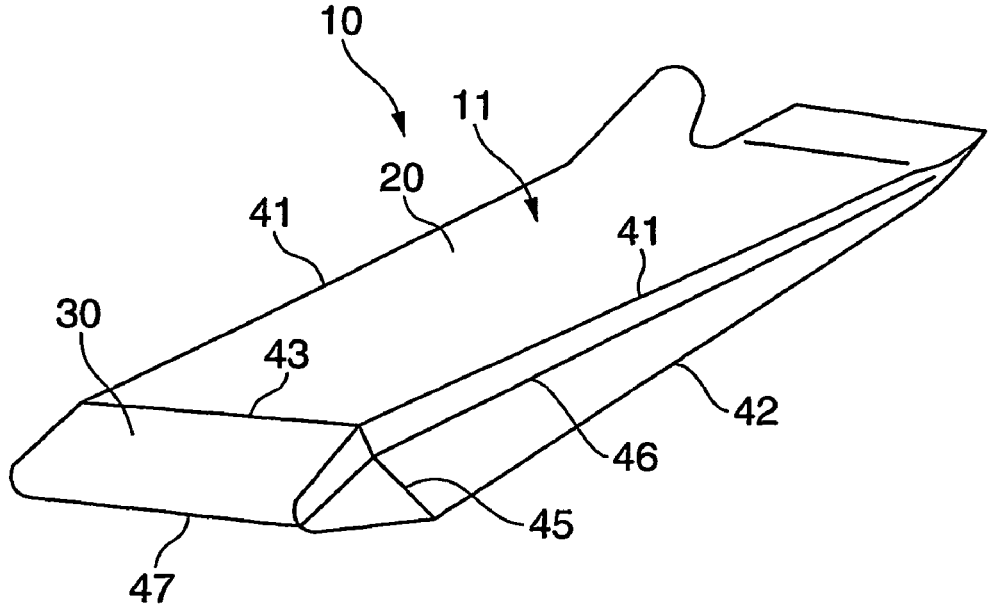

In the self-supporting bag 10, the entire of main body 11 of the bag may be folded in the following manner (FIGS. 2 to 4).

(a) An approximately two-dimensional folded form of folding is to flatten the body portion 20, bend the entire two-dimensional bottom portion 30 with respect to a lower portion of the body portion 20 and overlap the bottom portion 30 in parallel to the body portion 20. There are cases that the ridge line portion 46 of both the side surface portions 20C is protruded to an outer side of the body portion 20 (FIG. 2(A)), or is doubled in an inner side of the body portion 20 (FIG. 2(B)). The entire thickness in a folded state is thinner in the self-supporting bag 10 structured such that the ridge line portion 46 is protruded to the outer side.

(b) An approximately two-dimensional folded form of folding is to fold the ridge line portion 47 in a center portion of the bottom portion 30 into two toward the inner side of the body portion 20, double the two-folded bottom portion 30 in the inner side of the lower portion of the body portion 20, and flatten the body portion 20, thereby overlapping the bottom portion 30 in parallel to the body portion 20. There are cases that the ridge line portion 46 of both the side surface portions 20C is protruded to the outer side of the body portion 20 (FIG. 3(A)), or is doubled in the inner side of the body portion 20

(FIG. 3(B)). The entire thickness in a folded state is thinner in the self-supporting bag 10 structured such that the ridge line portion 46 is protruded to the outer side.

(c) An approximately two-dimensional folded form of folding is to fold the ridge line portion 47 in a center portion of the bottom portion 30 into two toward the outer side of the body portion 20, protrude the two-folded bottom portion 30 in the outer side of the lower portion of the body portion 20, and flatten the body portion 20, thereby overlapping the bottom portion 30 in parallel to the body portion 20. There are cases that the ridge line portion 46 of both the side surface portions 20C is protruded to the outer side of the body portion 20 (FIG. 4(A)), or is doubled in the inner side of the body portion 20 (FIG. 4(B)). The entire thickness in a folded state is thinner in the self-supporting bag 10 structured such that the ridge line portion 46 is protruded to the outer side.

The self-supporting bag 10 is provided with a fold maintaining means 50 for maintaining the folded state as mentioned above in items (a) to (c) of the bag's main body 11 in the following manner (FIGS. 5 to 8). In this case, the fold maintaining means 50 functions not only in a step of carrying and storing the self-supporting bag 10, but also in a step of disposing the self-supporting bag 10.

Figure 5:
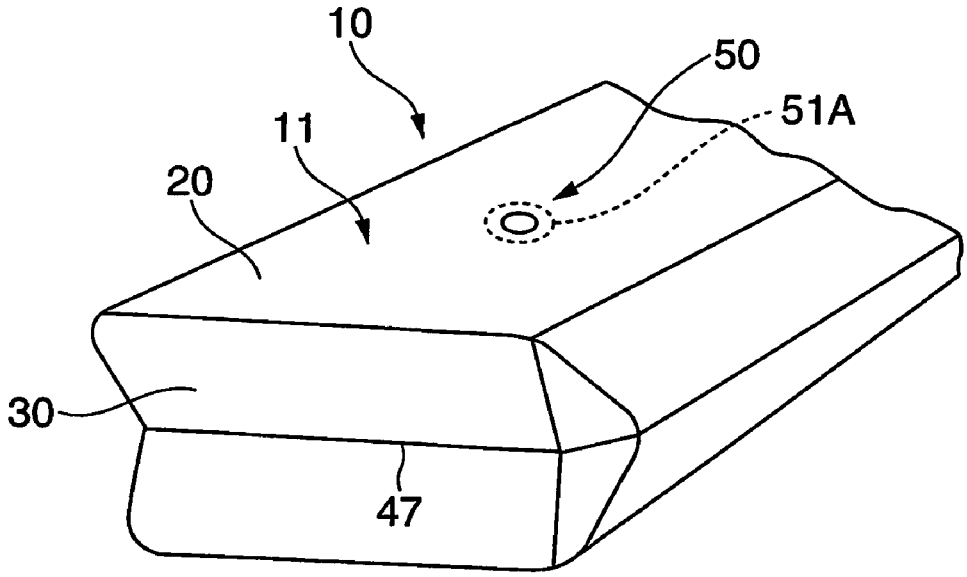
FIG. 5 is a schematic view showing a fold maintaining means.
Figure 5:
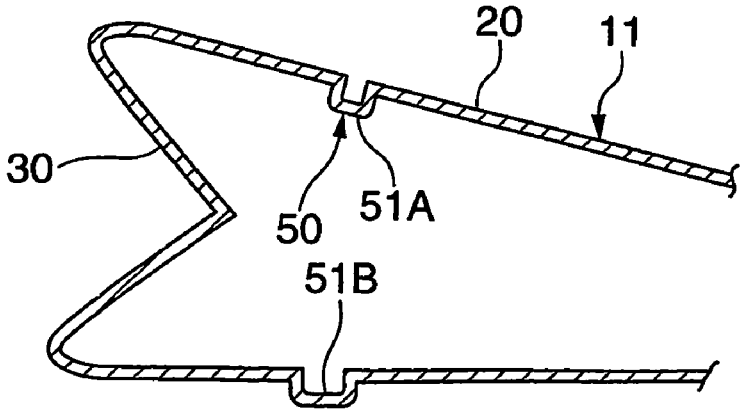

(1) In the self-supporting bag 10 (FIGS. 2 to 4) in accordance with any folded form of the items (a) to (c) mentioned above, a convex portion 51A and a concave portion 51B are provided respectively in opposing positions of the front portion 20A and the back surface portion 20B of the body portion 20 on the inner surface, and the convex portion 51A and the concave portion 51B can be freely engaged and disengaged under a two-dimensional folded state of the body portion 20 and the bottom portion 30 (FIG. 5). The folded state of the self-supporting bag 10 can be maintained by engaging the convex portion 51A with the concave portion 51B. It is preferable in view of inhibiting the bottom portion 30 from restoring to the shape prior to folding that the convex portion 51A and the concave portion 51B is provided close to each other by the bottom portion 30. The shape of the convex portion 51A and the concave portion 51B is not limited to a circular shape, but may be formed in a non-circular shape or the like.

Figure 6:
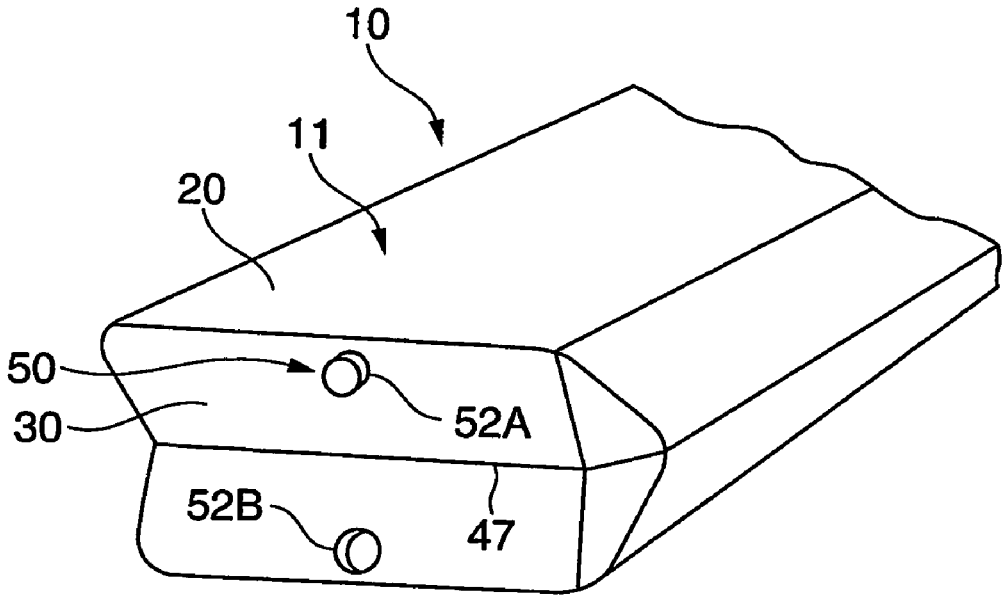
FIG. 6 is a schematic view showing the fold maintaining means.
Figure 6:
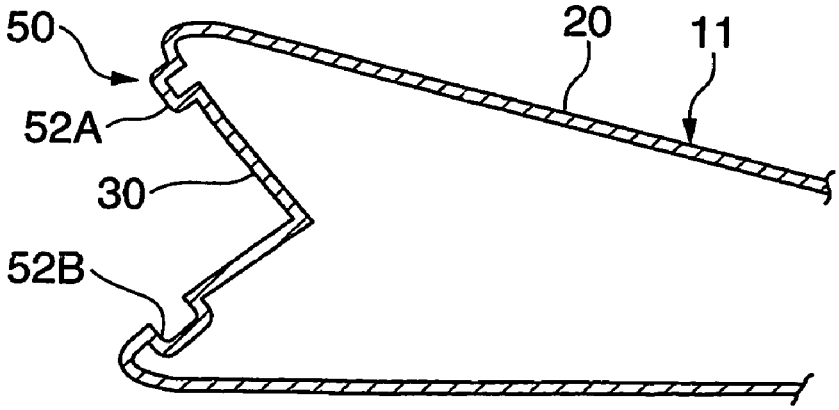

(2) In the self-supporting bag 10 (FIG. 3) in accordance with the folded form of the item (b) mentioned above, a convex portion 52A and a concave portion 52B are provided respectively in opposing positions on both sides holding the ridge line portion 47 between the outer side surfaces of the bottom portion 30, and the convex portion 52A and the concave portion 52B can be freely engaged and disengaged under a two-dimensional folded state of the body portion 20 and the bottom portion 30 (FIG. 6). The folded state of the self-supporting bag 10 can be maintained by engaging the convex portion 52A with the concave portion 52B. The shape of the convex portion 52A and the concave portion 52B is not limited to a circular shape, but may be formed in a non-circular shape or the like.

Figure 7:
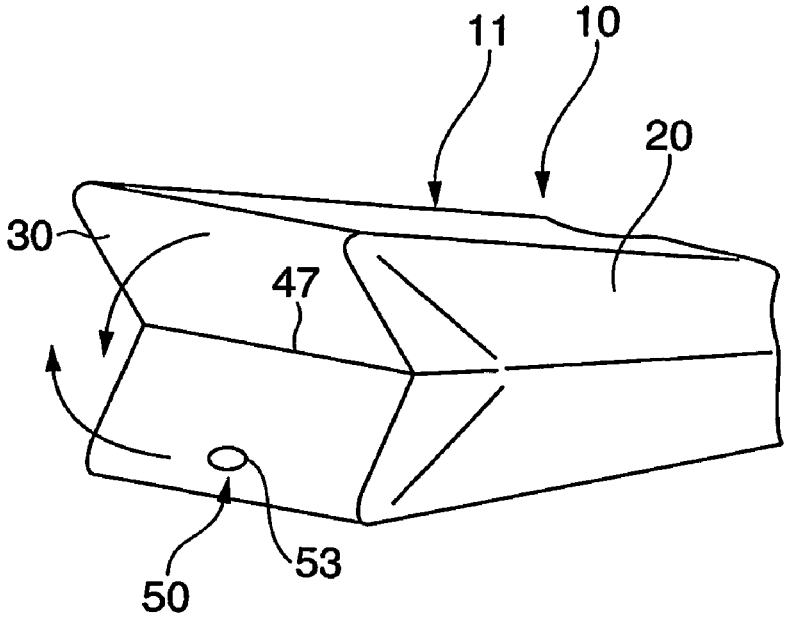
FIG. 7 is a schematic view showing the fold maintaining means.

(3) In the self-supporting bag 10 (FIG. 3) in accordance with the folded form of the item (b) mentioned above, a hot melt 53 is point attached to the outer surface on one side of the bottom portion 30 with respect to the ridge line portion 47, and the folded state of the self-supporting bag 10 is maintained by adhering both sides of the bottom portion 30 holding the ridge line portion 47 therebetween by means of the hot melt 53, under a state of folding the bottom portion 30 into two so as to double in the inner side of the body portion 20 (FIG. 7). A minimum amount of hot melt 53 capable of maintaining the folded state may be employed, and the hot melt 53 can be easily peeled at the time of using the self-supporting bag 10.

(4) In the self-supporting bag 10 (FIGS. 2 to 4) in accordance with the folded forms of the items (a) to (c) mentioned above, the folded state of the self-supporting bag 10 is maintained by temporarily fusion bonding the charging port 22A of the charging port forming portion 22 once, under the two-dimensional folded state of the body portion 20 and the bottom portion 30. The charging port 22A of the charging port forming portion 22 is cut and opened in the charging stage.

Figure 8:
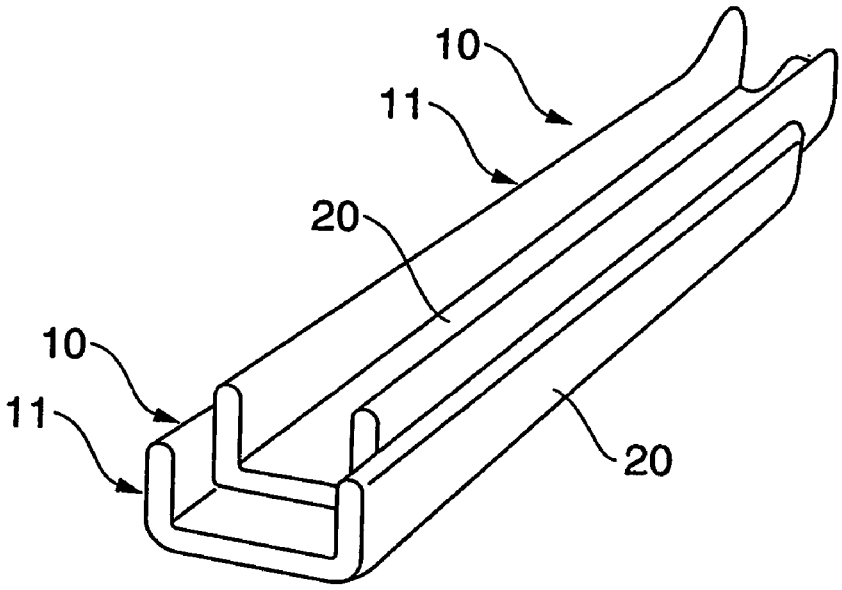
FIG. 8 is a schematic view showing the fold maintaining means.

(5) In the self-supporting bag 10 (FIGS. 2 to 4) in accordance with the folded forms of the items (a) to (c) mentioned above, the folded state of the self-supporting bag 10 is maintained by standing up both side portions of the body portion 20 and the bottom portion 30 in a width direction approximately perpendicularly, and applying an L-shaped folding habit to both side portions of transverse sections of the body portion 20 and the bottom portion 30, under the two-dimensional folded state of the body portion 20 and the bottom portion 30 (FIG. 8).

The self-supporting bag 10 is preferably used for a self-supporting bag formed as a product by fling with at least one or more of 0.1% to 50% surface active agent or 0.1% to 50% solvent, by weight, as a component.

In accordance with the self-supporting bag 10, the following effects can be obtained.

(1) In the self-supporting bag 10, it is possible to blow mold the synthetic resin flexible bag main body 11 in a three-dimensional shape (a stereoscopic shape), it is possible to fold the entire main body 11 of the bag in the step prior to filling the bag's main body 11, it is possible to flatly stack and store the self-supporting bag 10 in the approximately two-dimensional folded state in which the bottom portion 30 is overlapped in parallel to the body portion 20, and it is possible to restore the bag's main body 11 in the three-dimensional shape at the time of filling. The bag's main body 11 is formed in a thin flexible shape as an unitary body in accordance with the blow mold, and the amount of resin used is less in comparison with the conventional bag formed by laminating the film, and storage efficiency is improved by flatly stacking and storing the bags.

(2) Since the bag's main body 11 is formed in a three-dimensional shape, the bag's main body 11 has a fixed rigidity, and has an improved self-supporting property in an empty state. Accordingly, the bag's main body 11 stably self-supports even when the bag's main body 11 is placed in a carrying device at the time of being carried to the filling line or the like, and its handling property is improved.

(3) Since the charging port forming portion 22 of the bag's main body 11 is formed in a three-dimensional shape, the opposing surfaces are not closely attached to each other even when the bag's main body 11 is folded, and it is possible to easily form the charging port 22A.

(4) The bag's main body 11 is provided with the ridge line portions 41 to 45. The ridge line portions 41 to 45 form a guide wire for folding at a time of folding the bag's main body 11, whereby the ability to easily fold can be improved. Further, the ridge line portions 41 to 45 finely define profiles of front and back surfaces and side surfaces of the bag's main body 11 at the time of filing the bag's main body 11 so as to restore the bag's main body 11, and it is possible to improve the aesthetic external appearance of the bag's main body 11.

(5) The self-supporting bag 10 is provided with fold maintaining means 50 for maintaining the folded state of the bag's main body 11. Accordingly, when folding the bag's main body 11 so as to easily carry and improve the storage efficiency of the self-supporting bag 10 in the carrying and storing stage prior to filling the bag's main body 11, it is possible to stably maintain the bag's main body 11 in an original folded state, as opposed to usually having to restore the bag's main body 11 to its three-dimensional shape at the time of being formed. Accordingly, the bag's main body 11 can be flatly stacked and stored stably for a long time while maintaining the folded state and without being bulky, and it is possible to improve the carrying and storage efficiency of the self-supporting bag 10. Further, in the disposing stage of the self-supporting bag 10, it is possible to maintain the folded state when disposing so that the volume of waste can be minimized, and it is easy to dispose.

Further, the self-supporting bag 10 also has the following effects.

(1) The charging port 22A for the contents of the bag's main body 11 can be provided along the entire width or most of the entire width of the upper edge of the body portion 20 in the bag main body 11, and it is easier to fill.

(2) The pouring port 14 on the bag's main body 11 can be formed as a part of the body portion 12 at the time of blow molding the bag's main body 11, or can be formed by sealing the open portion of the upper edge of the blow molded body portion 12. Further, since the pouring port 24A is formed in a three-dimensional shape at the time of blow molding the bag's main body 11, it may be difficult to close the pouring port 24A.

(3) The folding form of the bag's main body 11 may be formed in an approximately flat shape obtained by overlapping the body portion 20 and the bottom portion 30.

(4) Since the bag's main body 11 is blow molded, it is possible to widely omit the cutting operation of the film and the sealing operation of the film which are necessary for the conventional self-supporting bag, so that the manufacturing step is simplified.

(5) The bag's main body 11 is obtained by forming the body portion 20 and the bottom portion 30 in a three-dimensional shape, a wrinkle is not generated in the body portion 20 at a time when the body portion 20 is bulged when filling, and it is possible to improve the aesthetic external appearance of the bag's main body 11.

(6) Since the bag's main body 11 is not structured by laminating the sheets, it is not always necessary to structure the bag's main body 11 by the laminated film via the adhesive layer. Accordingly, it is possible to structure the bag's main body 11 by a single layer of film. The peeling of the laminated film is usually generated due to the intrusion of the bag's content such as a surface active agent or solvent into the adhesive layer of the laminated film, and thus it is possible to stabilize the bag quality.

(7) The body portion 20 and the bottom portion 30 of the bag's main body 11 are integrally formed and its structure is strong against the impact caused by dropping and is difficult to crack.

(8) Since the pouring port 24A formed in the bag's main body 11 is inclined at an angle between 0 degree and 90 degrees with respect to a horizontal direction in parallel to the bottom portion 30 of the bag's main body 11, preferably in a range between 30 degrees and 60 degrees, and most appropriately at an angle of 45 degrees, the pouring port 24A can be formed so it is easy to pour.

(9) Since it is possible to design a metal mold such that the pouring port 24A formed in the bag's main body 11 protrudes to an outer side of the bag's main body 11, the protruding shape can be freely structured, and it is possible to easily manufacture the bag having an easy pouring property, by elongating the protruding length of the pouring port, widening an opening width of the pouring port, and the like.

In this case, the self-supporting bag in accordance with the present invention is not limited to the structure formed by the blow mold as far as the self-supporting bag is formed by the metal mold. The self-supporting bag may be formed by injection molding or the like.

Second Embodiment

Figure 9:
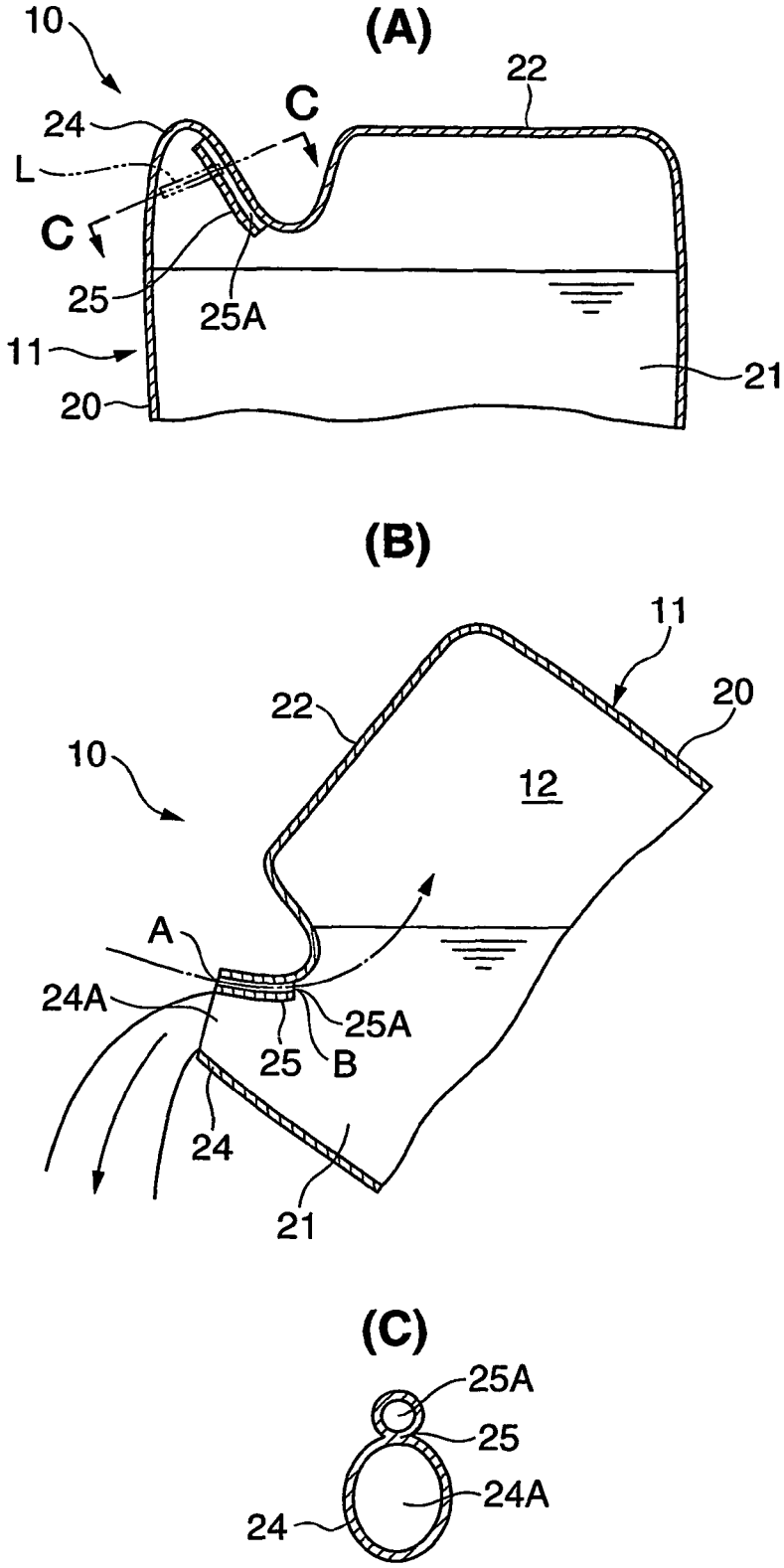
FIG. 9 is a cross sectional view showing a main portion of a self-supporting bag in accordance with a second embodiment.
Figure 10:
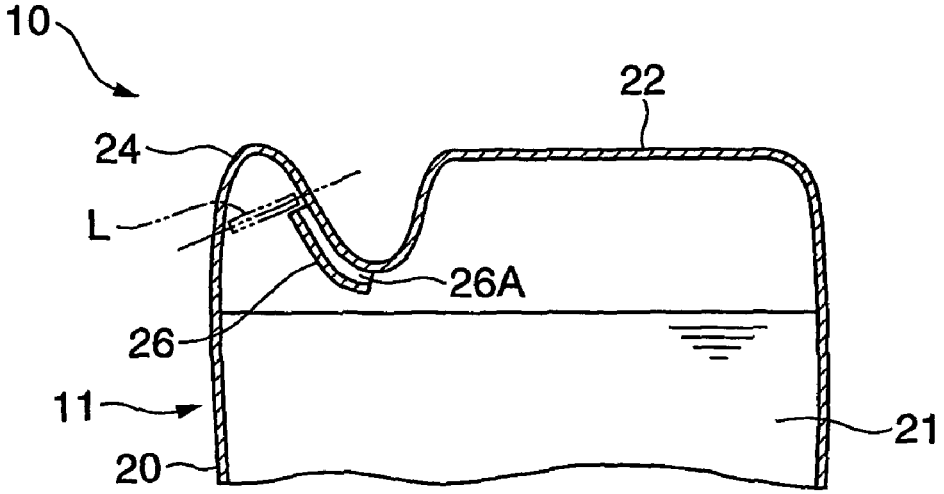
FIG. 10 is a cross sectional view showing a modified example of the second embodiment.
Figure 11:
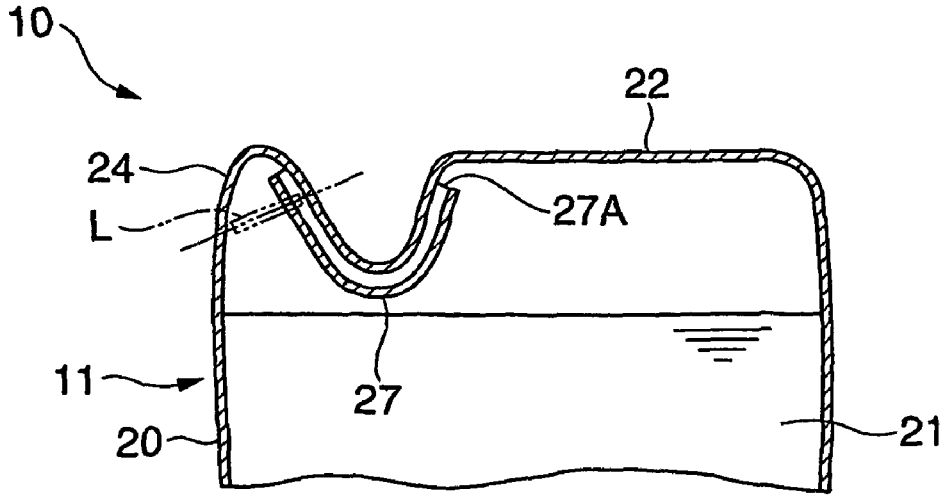
FIG. 11 is a cross sectional view showing another modified example of the second embodiment.

FIGS. 9 to 11

In the self-supporting bag 10, the pouring port 24A is opened by cutting along a cut line L depressed along an outer periphery of the pouring port forming portion 24 (FIG. 1). A description will be given of a self-supporting bag in which the pulsation of the poured liquid is hard to be generated at a time of pouring the contents from the pouring port 24A.

The self-supporting bag 10 is provided with an air communication passage forming portion 25 for making an intrusion of the ambient air into the inner portion of the bag's main body 11 at the time of pouring from the pouring port 24A formed in the bag's main body 11, by forming at the time of blow molding the bag's main body 11, as shown in FIG. 9 (in which FIG. 9(C) is a cross sectional view along a line C-C in FIG. 9(A)). The air communication passage forming portion 25 in accordance with the present embodiment is formed in a partition wall shape arranged in parallel to the pouring port forming portion 24, and forms a tubular air communication passage 25A. The pouring port forming portion 24 and the air communication passage forming portion 25 are cut at the same time along the cut line L, and thus the pouring port 24A and the air communication passage 25A are cut open in parallel to the outer side of the bag. One end of the opened air communication passage 25A facing to the outer side of the bag forms an ambient air intake port A, and another end facing to the inner side of the bag forms an ambient air discharging port B.

In this case, in the present embodiment, both ends of the air communication passage 25A are open to the inner side of the bag before cutting the pouring port forming portion 24 and the air communication passage forming portion 25. In this case, an end portion close to the ambient air intake port A by opening the air communication passage 25A may be closed before cutting the pouring port forming portion 24 and the air communication passage forming portion 25.

The self-supporting bag 10 can be manufactured in accordance with direct blow molding.

The direct blow molding forms the bag's main body 11 by extruding a parison, clamping the parison in the metal mold, and thereafter blowing the air into the inner portion of the parison so as to draw in a circumferential direction. The direct blow molding forms the bag's main body 11 constituted by a single layer or a laminated resin layer. As a constituting resin material of the bag's main body 11 formed by direct blow molding, it is possible to employ a low density polyethylene (LDPE), a linear low density polyethylene (L-LDPE) or a high density polyethylene (HDPE) in the case of the single layer, and it is possible to employ a high density polyethylene (HDPE) for an outer layer and the LDPE or the L-LDPE for an inner layer in the case of the laminated layer. Further, in order to improve oxygen barrier properties, it is possible to employ an ethylene-vinyl alcohol copolymer (EVOH) or a nylon for an intermediate layer.

The self-supporting bag 10 can be structured such that the bottom portion 30 is lapped over the body portion 20 in the following manner (a) or (b), in a folding form of the bag's main body 11 thereof.

(a) A form that the body portion 20 is flattened and the flat-shaped bottom portion 30 is bent with respect to the lower portion of the body portion 20.

(b) A form that the bottom portion 30 is formed so as to be bulged in a dome shape, the center portion of the bottom portion 30 is doubled in the inner side of the body portion 20 along a parting line of the blow molding metal mold, and the body portion 20 is flattened.

The self-supporting bag 10 is preferably used as a self-supporting bag constituting a product by filling with at least one of 0.1% to 50% surface active agent and 0.1% to 50% solvent by percent weight.

In accordance with the self-supporting bag 10, the following operation and effects are obtained.

(1) The bag's main body 11 is formed in a three-dimensional shape, and has a fixed rigidity. Accordingly, it is easy to support the bag's main body 11 at the time of pouring out the contents, and its pouring property is good.

(2) At the time of pouring out the contents, an air gap portion 12 under a negative pressure state requiring an air replacement is generated in the inner portion of the bag's main body 11, the ambient air makes an intrusion from the ambient air intake port A of the air communication passage 25A which is arranged over the pouring port 24A and is exposed to a lower liquid pressure application (a single-dot chain line in FIG. 9(B)), and the ambient air is discharged into the bag from the ambient air discharging port B of the air communication passage 25A, forms an air bubble so as to communicate with the contents, and makes an intrusion into the air gap portion 12 while the air bubble rises upward. Since the air communication passage 25A is a small flow passage sectioned with respect to the pouring port 24A, the air bubble of the ambient air is small, the bursting in the air gap portion 12 is small, and the content does not pulsate when pouring from the pouring port 24A.

(3) Since the pouring port forming portion 24 and the air communication passage forming portion 25 are arranged in parallel in the bag's main body 11, it is possible to cut both the forming portions 24 and 25 at the same time, and it is possible to simultaneously form the pouring port 24A and the air communication passage 25A.

(4) Even when the residual amount of the content is reduced, it is possible to reduce the residual amount without closing the flow passage for pouring the contents due to the close attachment between the receiving portions 21.

The self-supporting bag 10 in FIG. 10 corresponds to a modified example of the second embodiment, and is structured such that an air communication passage forming portion 26 is provided in the inmost recesses of the inner portion of the bag's main body 11 from the cut line L of the pouring port forming portion 24 in the bag main body 11, whereby an air communication passage 26A can be formed.

The self-supporting bag 10 in FIG. 11 corresponds to another modified example of the second embodiment, and is structured such that an U-shaped extended air communication passage forming portion 27 is provided so as to extend from a position in parallel to the pouring port forming portion 24 to an opposite side of the pouring port forming portion 24 (close to the charging port forming portion 22), along the upper edge portion of the bag's main body 11, whereby an air communication passage 27*a* can be formed. The ambient air introduced by the air communication passage 27A directly enters into the air gap portion 12 of the bag's main body 11 without communicating with its contents.

Third Embodiments

Figure 12:
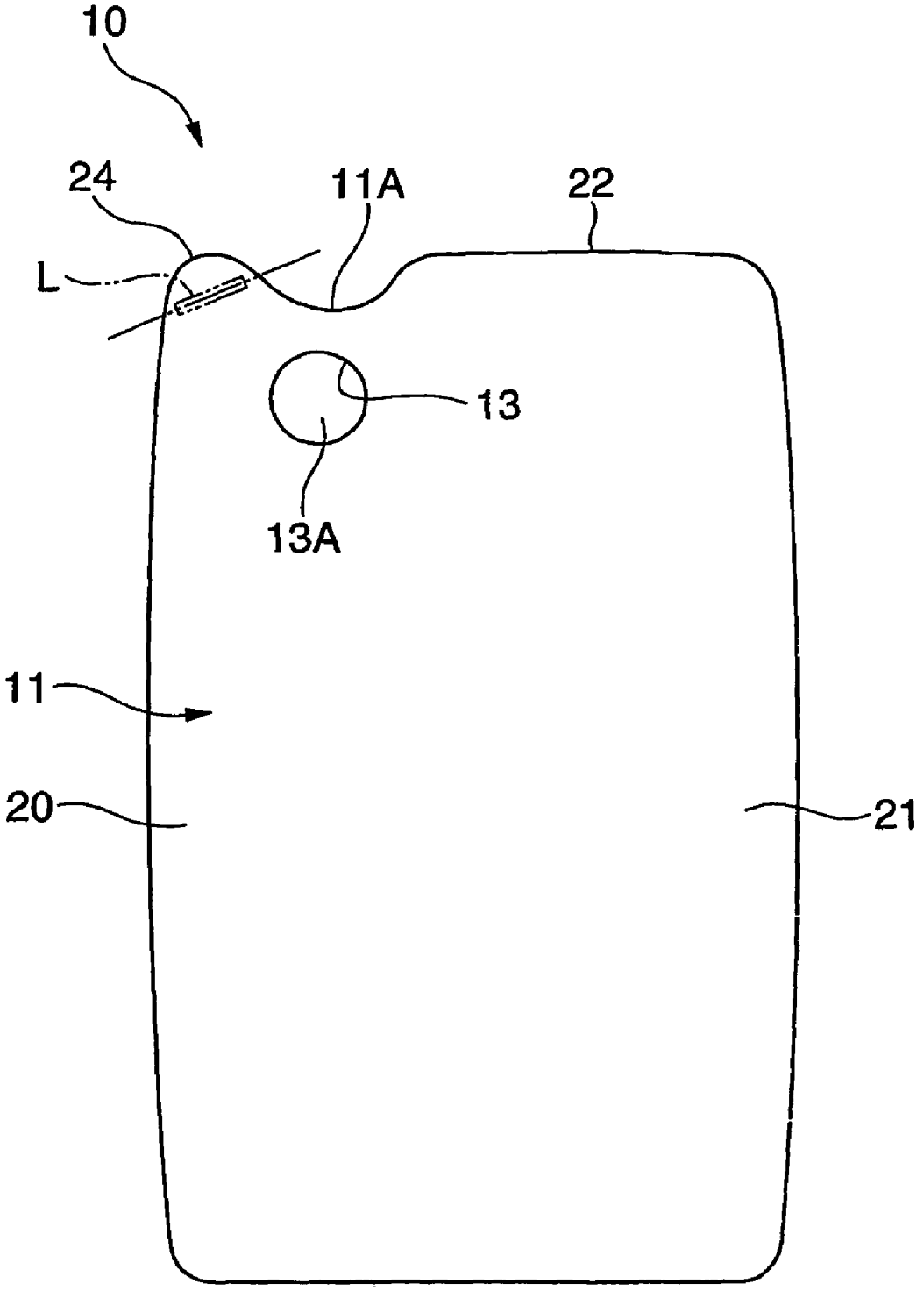
FIG. 12 is a schematic view showing a self-supporting bag in accordance with a third embodiment.
Figure 13:
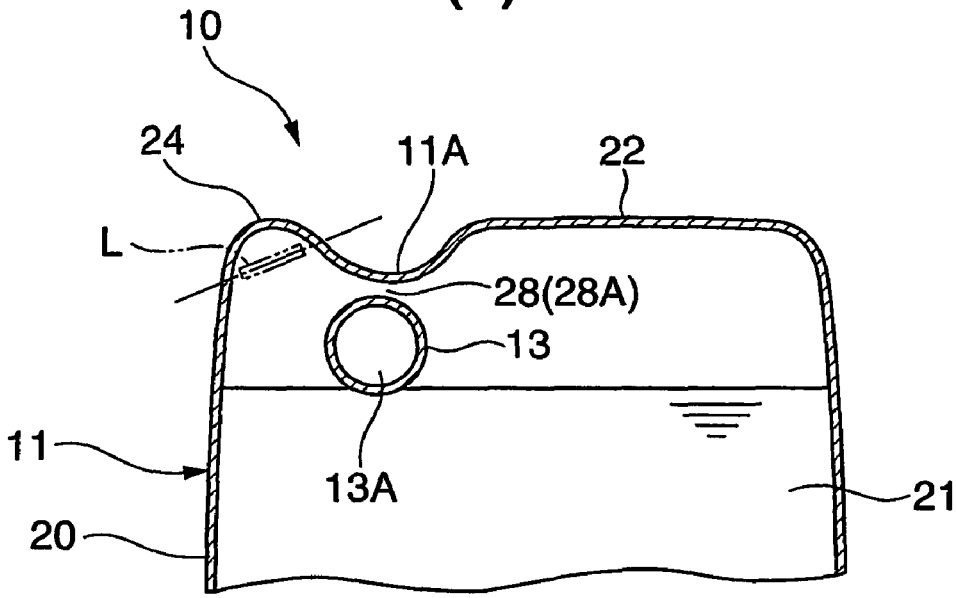
FIG. 13 is a cross sectional view showing a main portion in FIG. 12.
Figure 13:
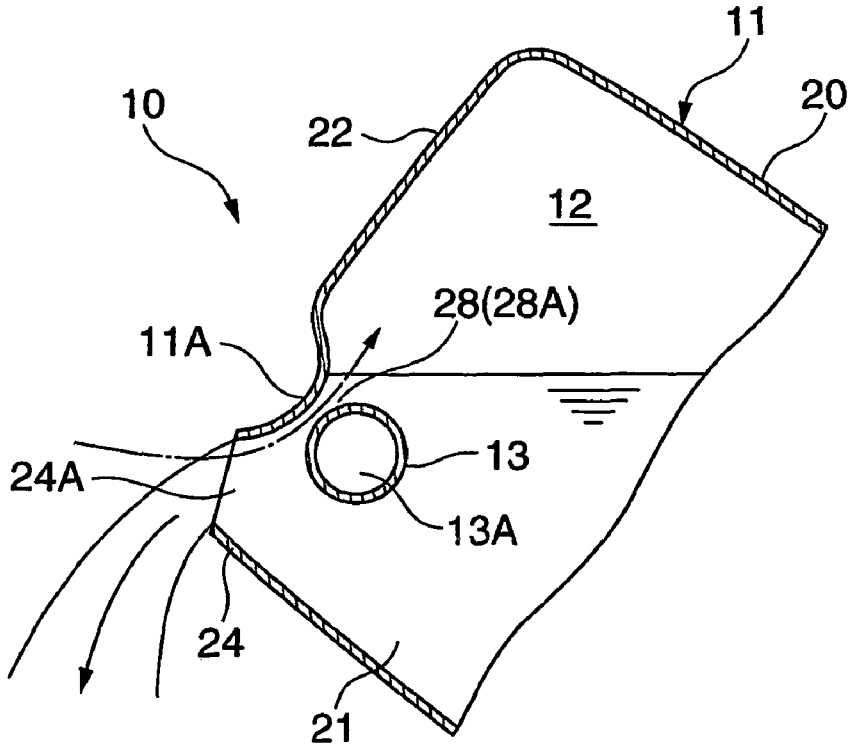

FIGS. 12 and 13

The self-supporting bag 10 in accordance with a third embodiment is different from the self-supporting bag 10 in accordance with the second embodiment where a hanging hole forming portion 13 (a hanging hole 13A) positioned by the side of the pouring port forming portion 24 in the upper portion of the bag's main body 11 is formed at a time of blow molding the bag's main body 11, and an air communication passage forming portion 28 is formed between the upper edge portion 11A of the bag's main body 11 and the hanging hole forming portion 13, whereby an air communication passage 28A can be formed, as shown in FIGS. 12 and 13.

In accordance with the self-supporting bag 10, the following effects can be obtained.

(1) The bag's main body 11 is formed in a three-dimensional shape, and has a fixed rigidity. Accordingly, it is easy to support the bag's main body 11 at a time of pouring out its contents, and its pouring property is good.

(2) At the time of pouring out its contents, an air gap portion 12 under a negative pressure state requiring an air replacement is generated in the inner portion of the bag's main body 11, the ambient air makes an intrusion from the air communication passage 28A which is arranged over the pouring port 24A by being provided close to the upper edge portion of the bag's main body 11 and is exposed to a lower liquid pressure application (a single-dot chain line in FIG. 13(B)), and the ambient air forms an air bubble so as to communicate with its contents, and makes an intrusion into the air gap portion 12 while the air bubble rises upward. Since the air communication passage 28A is a small flow passage formed between the upper edge portion of the bag's main body 11 and the hanging hold forming portion 13, the air bubble of the ambient air is small, the bursting in the air gap portion 12 is small, and the content does not pulsate when pouring from the pouring port 24A.

(3) The hanging hole 13A of the bag's main body 11 can be used as a handle for supporting the bag's main body 11 by inserting fingers thereto at the time of pouring.

Fourth Embodiment

FIG. 14

Figure 14:
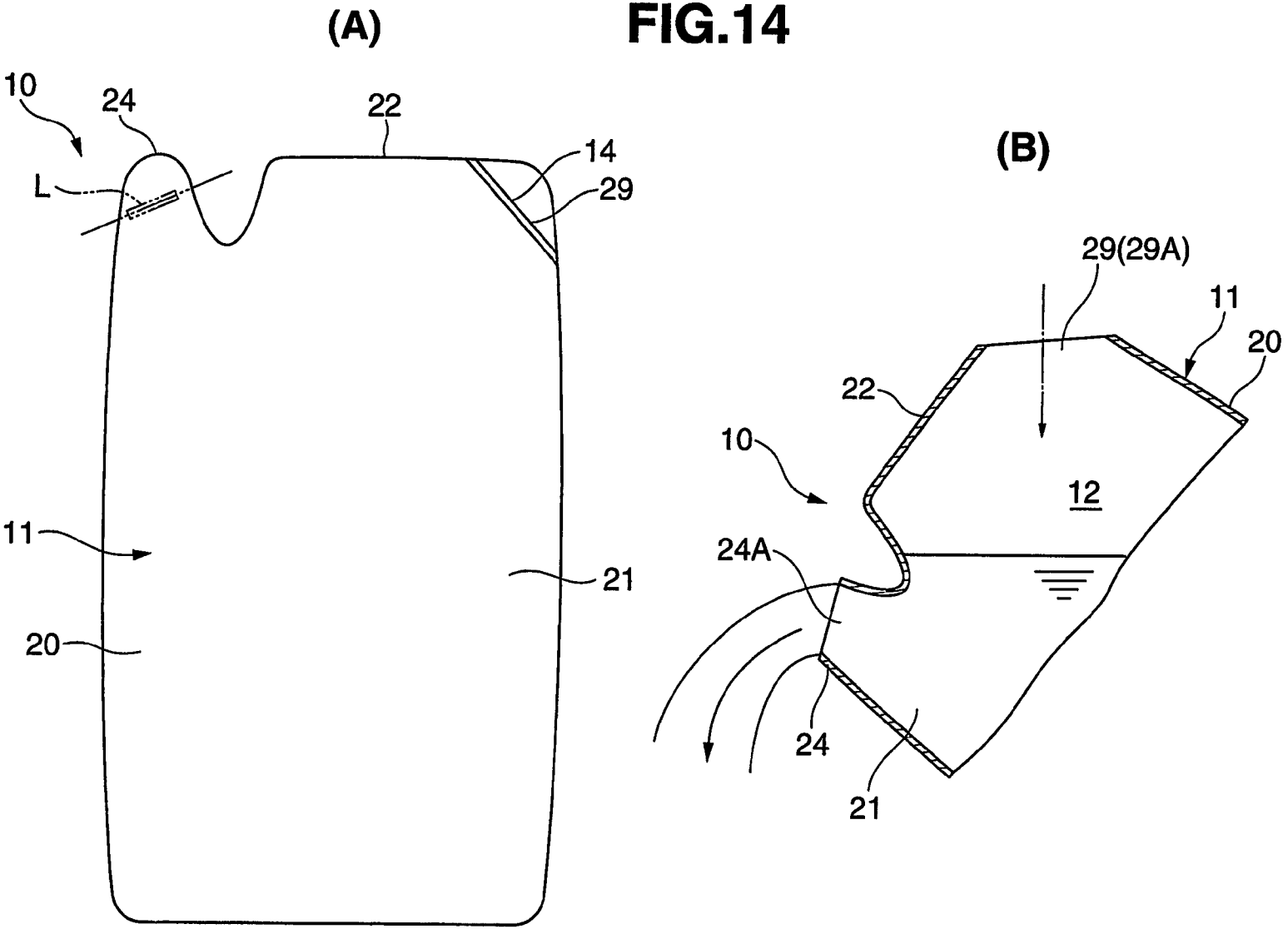
FIG. 14 is a schematic view showing a self-supporting bag in accordance with a fourth embodiment.
Figure 15:
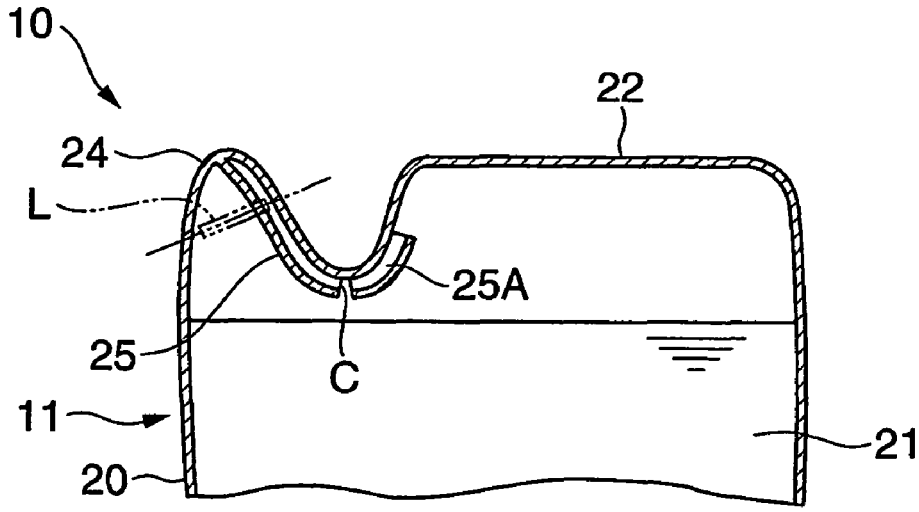
FIG. 15 is a schematic view showing a main portion of a self-supporting bag in accordance with a fifth embodiment.
Figure 15:
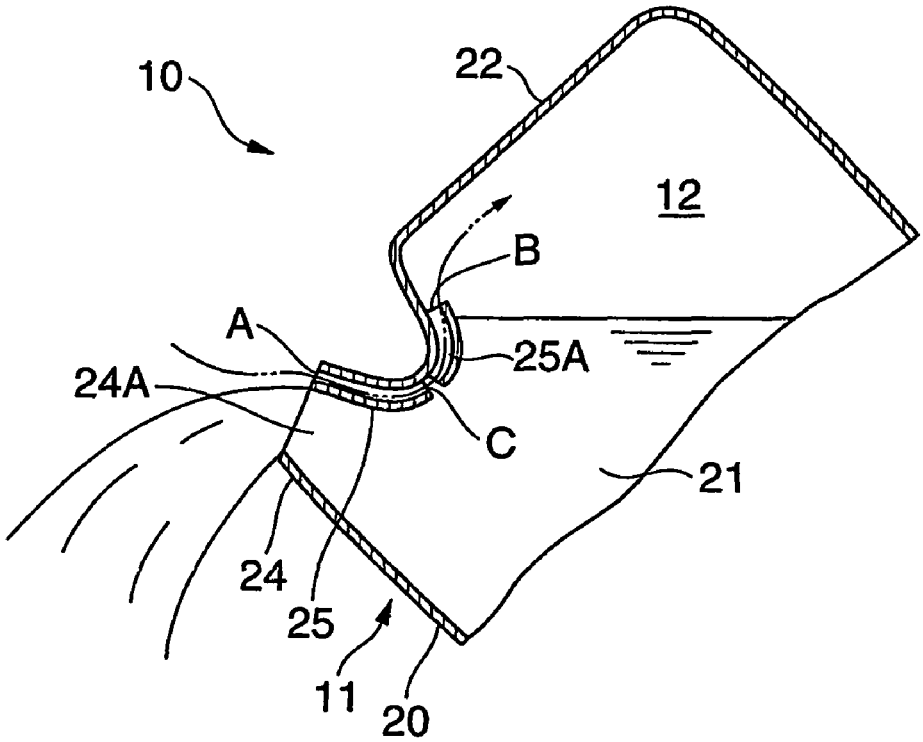
Figure 16:
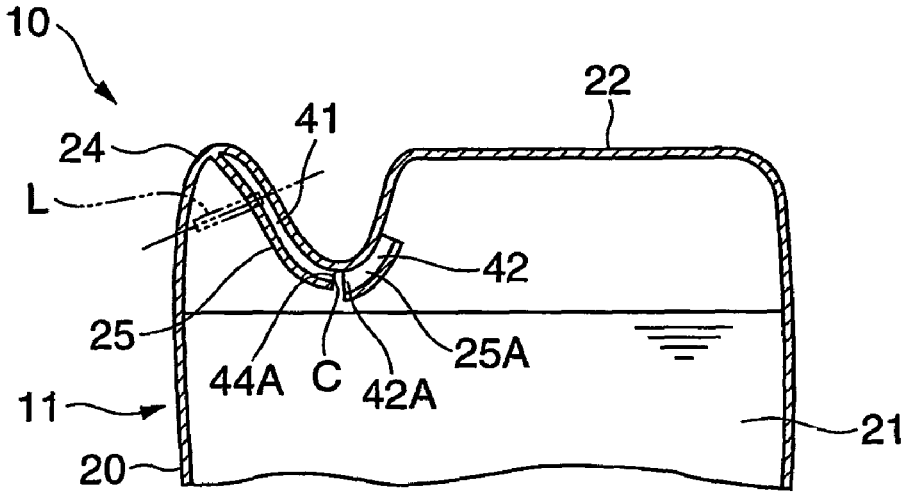
FIG. 16 is a schematic view shoring a main portion of a self-supporting bag in accordance with a sixth embodiment.
Figure 16:
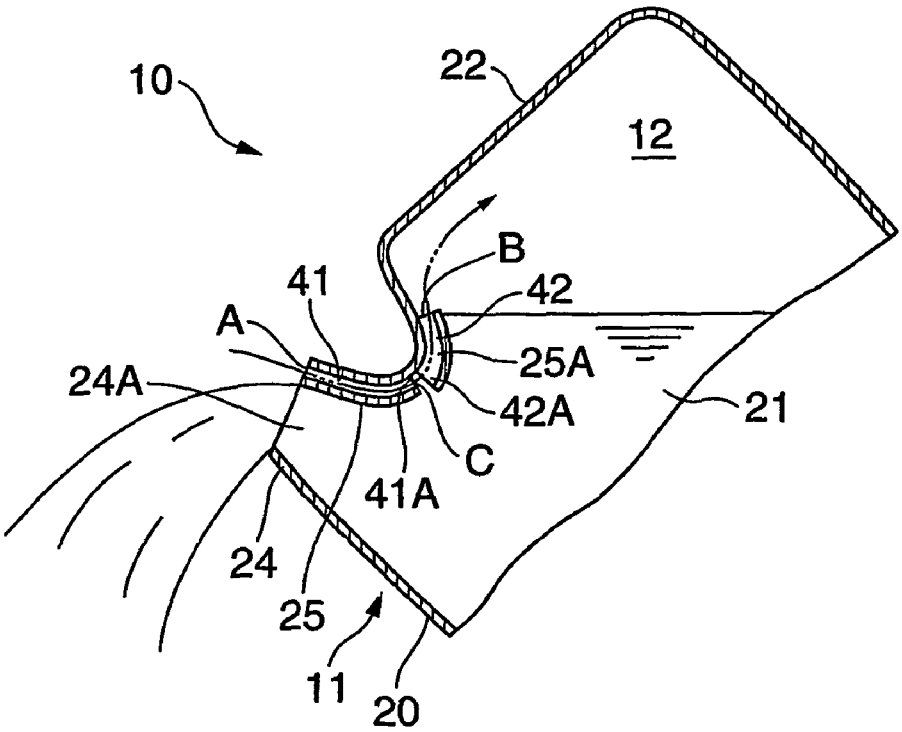
Figure 17:
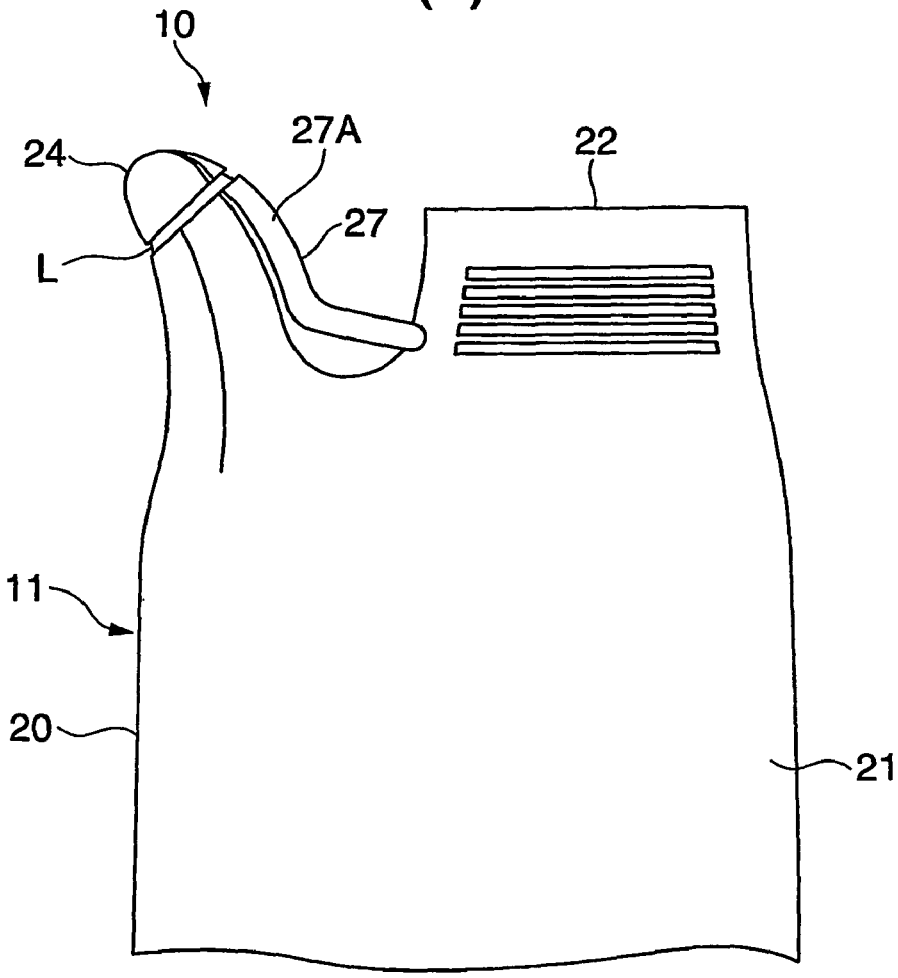
FIG. 17 is a schematic view showing a self-supporting bag in accordance with a seventh embodiment.
Figure 17:
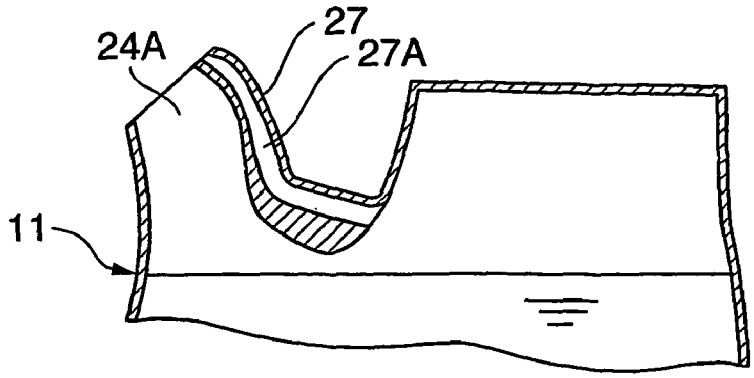

The self-supporting bag 10 in accordance with a fourth embodiment is different from the self-supporting bag 10 in accordance with the second embodiment where an air communication passage forming portion 29 to which a cut proposed line 14 is applied in accordance with a printing or the like is provided in an opposite side to the pouring port forming portion 24, along a pouring direction of the contents from the bag's main body 11, whereby an air communication passage 29A can be formed, as shown in FIG. 14.

In accordance with the self-supporting bag 10, the following effects can be obtained.

(1) The bag's main body 11 is formed in a three-dimensional shape, and has a fixed rigidity. Accordingly, it is easy to support the bag's main body 11 at a time of pouring out its contents and its pouring property is good.

(2) At the time of pouring out the contents, an air gap portion 12 requiring an air replacement is generated in the inner portion of the bag's main body 11, and an intrusion of the ambient air is generated from the air communication passage 29A formed by cutting the cut proposed line 14 provided in the opposite side to the pouring port 24A in the bag's main body 11, to the air gap portion 12 (a single-dot chain line in FIG. 14(B)). Since the ambient air directly enters into the air gap portion 12 without communicating with its contents, the rupture of the air gap is not generated in the air gap portion 12, and the content does not pulsate when pouring from the pouring port 24A.

(3) The air communication passage forming portion 29 can be provided by a simple structure obtained only by applying the cut proposed line 14 to the bag's main body 11.

Fifth Embodiment

FIG. 15

The self-supporting bag 10 in accordance with a fifth embodiment is provided with an air communication passage forming portion 25 for making an intrusion of the ambient air into the inner portion of the bag's main body 11 at the time of pouring its contents from the pouring port 24A formed in the bag's main body 11, by forming at a time of blow molding the bag's main body 11, in the same manner as the self-supporting bag 10 in accordance with the second embodiment. The air communication passage forming portion 25 is extended in a U shape so as to extend from a position in parallel to the pouring port forming portion 24 to an opposite side of the pouring port forming portion 24 (close to the charging port forming portion 22), along the upper edge portion of the bag's main body 11. The air communication passage forming portion 25 is formed in a partition wall shape arranged in parallel to the pouring port forming portion 24, and forms a tubular air communication passage 25A. The pouring port forming portion 24 and the air communication passage forming portion 25 are cut at the same time along the cut line L, and the pouring port 24A and the air communication passage 25A are cut open in parallel to the outer side of the bag. One end of the opened air communication passage 25A facing to the outer side of the bag forms an ambient air intake port A, and another end facing to the inner side of the bag forms an ambient air discharging port B. The ambient air discharging port B of the air communication passage 25A can be set such as to be positioned above a liquid surface of the receiving portion 21 for the contents at a time when the bag's main body 11 erects, and in this case, the ambient air discharged from the ambient air discharging port B can directly enter into the air gap portion 12 of the bag's main body 11 without communicating with its contents.

In this case, in the present embodiment, one end of the air communication passage 25A (an end portion forming the ambient air intake port A) is closed before cutting the pouring port forming portion 24 and the air communication passage forming portion 25. In this case, both ends of the air communication passage 25A may be opened to the inner side of the bag before cutting the pouring port forming portion 24 and the air communication passage forming portion 25.

The self-supporting bag 10 is provided with a hole-shaped communication passage C communicating an intermediate portion of the air communication passage 25A formed by the air communication passage forming portion 25 with the receiving portion 21 for the contents in the inner portion of the bag's main body 11. The communication passage C is provided in a lowermost portion of the intermediate portion of the air communication passage 25A in a vertical direction in a state of erecting the bag's main body 11, and is preferably positioned above the liquid surface of the bag's main body 11 before being opened.

In the self-supporting bag 10, the contents of the bag's main body 11 makes an intrusion into the air communication passage 25A from the ambient air discharging port B of the air communication passage 25A or the like, at a time when the bag's main body 11 is stored long-term in a sideways falling state. When erecting the bag main body 11 thereafter, the content making an intrusion into the air communication passage 25A gets out of the communication port C so as to be discharged over the liquid surface of the bag's main body 11. Accordingly, if the communication port C does not exist at the time of erecting the bag's main body 11 from the sideways falling state, the contents making an intrusion into the air communication passage 25A is brought into contact with the air atmosphere within the narrow passage so as to be solidified, and by extension closes the air communication passage 25A so as to avoid the risk that the air replacement function is lost.

In accordance with the self-supporting bag 10, the following operation and effects are obtained.

(1) The bag's main body 11 is formed in a three-dimensional shape, and has a fixed rigidity. Accordingly, it is easy to support the bag's main body 11 at the time of pouring out the contents, and its pouring property is good.

(2) At a time of storing long-term the self-supporting bag 10, its content which makes an intrusion into the air communication passage 25A due to the sideways falling state of the bag's main body 11, gets out of the communication port C due to the thereafter erection of the bag's main body 11, the solidification of the contents is not generated in the inner portion of the air communication passage 25A, and it is possible to stably maintain the air communication performance of the air communication passage 25A.

Accordingly, at the pouring time of the contents which is carried out by opening the pouring port 24A and the air communication passage 25A of the bag's main body 11, the ambient air making an intrusion from the ambient air intake port A of the air communication passage 25A makes an intrusion into the air gap portion 12 under the negative pressure state in the inner portion of the bag's main body 11 through its contents via the ambient air discharging port B, or directly via the ambient air discharging port B. At this time, the ambient air making an intrusion into the air communication passage 25A from the ambient air intake port A is sucked into the air gap portion 12 from the ambient air discharging port B due to the negative pressure of the air gap portion 12 and does not leak out into the liquid from the communication port C in the intermediate portion of the air communication passage 25A. Since the air communication passage 25A is a small flow passage sectioned with respect to the pouring port 24A, the air bubble of the ambient air mentioned above discharged from the air communication passage 25A to the air gap portion 12 is small, the bursting in the air gap portion 12 is small, and the content does not pulsate when pouring from the pouring port 24A.

(3) Since the pouring port forming portion 24 and the air communication passage forming portion 25 are arranged in parallel in the bag's main body 11, it is possible to cut both the forming portions 24 and 25 at the same time, and it is possible to simultaneously form the pouring port 24A and the air communication passage 25A.

Sixth Embodiment

FIG. 16

The self-supporting bag 10 in accordance with a sixth embodiment is different from the self-supporting bag 10 in accordance with the fifth embodiment where a bore diameter of an opening 42A of a second air communication passage 42 in a side having the ambient air discharging port B communicating with the inner portion of the bag main body 11 is made larger than a bore diameter of an opening 41A of a first air communication passage 41 in a side having the ambient air intake port A communicating with the outer portion of the bag's main body 11, between the opposing openings 41A and 42A of two air communication passages 41 and 42 communicating with each other via the communication port C of the air communication passage 25A formed by the air flow passage forming portion 25.

The opening 42A of the second air communication passage 42 with respect to the opening 41A of the first air communication passage 41 is formed in a socket shape, in an intermediate portion (the communication port C) in an intruding direction of the ambient air moving from the ambient intake port A of the first air communication passage 41 constituting the air communication passage 25 toward the ambient air discharging port B of the second air communication passage 42, at a time of pouring out its contents from the self-supporting bag 10. Accordingly, the ambient air making an intrusion from the ambient air intake port A of the air communication passage 25A (the first air communication passage 41) is picked up by the socket-shaped opening 42A having the large bore diameter from the opening 41A having the small bore diameter in the intermediate portion (the communication port C) of the air communication passage 25A, does not leak out into the liquid from the communication port C, and securely makes an intrusion into the air gap portion 12 in the inner portion of the bag's main body 11 through the same passage as that in the fourth embodiment, through the ambient air discharging port B of the air communication passage 25A (the second air communication passage 42).

Seventh Embodiment

FIG. 17

The self-supporting bag 10 in accordance with a seventh embodiment is different from the self-supporting bag 10 (FIG. 11) in accordance with the first embodiment in a point that an air communication passage forming portion 27 is provided in such a manner that an air communication passage 27A forms a down slope from a position in parallel to the pouring port forming portion 24 in the upper edge portion of the bag's main body 11 toward the receiving portion 21 of the contents in a state of erecting the self-supporting bag 10. In accordance with this structure, even if the contents makes an intrusion into the air communication passage 27A due to the sideways falling of the self-supporting bag 10, it is possible for the contents to flow down within the air communication passage 27A to a side of the receiving portion 21 by erecting the self-supporting bag 10 so as to drain the contents, so that the air replacement property achieved by the air communication passage 27A is not deteriorated. Further, an entire length of the air communication passage 27A becomes shorter than the structure in which the air communication passage 27A is extended in the U shape, and the air replacement property is improved.

In accordance with the present invention, in the self-supporting bag, it is possible to improve the self-supporting property in the empty state while making the entire main body of the bag foldable, and it is possible to easily form the charging port.

Further, in accordance with the present invention, in the self-supporting bag, it is easy to support the self-supporting bag by using hands at the time of pouring out its contents, and the pulsation of the poured liquid is substantially prevented. Further, it is possible to reduce the residual amount of the content remaining after pouring.

What is claimed is:

1. A method of preparing a self-supporting bag, comprising:

molding a main body of the self-supporting bag, including a body portion and a bottom portion;

folding the main body of the self-supporting bag, including the body portion and the bottom portion, such that the bottom portion is parallel to the body portion and the self-supporting bag is flat; and folding the folded self-supporting bag by standing up both side portions of the body portion and the bottom portion in a width direction while center portions of the body portion and the bottom portion remain flat such that the self-supporting bag is L-shaped on both of the side portions to maintain the self-supporting bag in a folded state, wherein the body portion includes a front surface such that, when the bag is folded by standing up both side portions of the body portion, a left side of the front surface faces a right side of the front surface with a center portion of the front surface located between the left side and the right side, and wherein the main body is comprised of synthetic resin.

2. The method of preparing a self-supporting bag according to claim 1, wherein the folding the main body includes folding the bottom portion into two toward an inner side of the body portion so as to fold the bottom portion in parallel to the body portion.

3. The method of preparing a self-supporting bag according to claim 1, wherein the folding the main body includes folding the bottom portion into two toward an outer side of the body portion so as to fold the bottom portion in parallel to the body portion.

4. The method of preparing a self-supporting bag according to claim 1, further comprising:

a maintaining means for maintaining the folded state of the bag's main body.

5. The method of preparing a self-supporting bag according to claim 1, wherein a pouring port is formed in the bag's main body, and the self-supporting bag is provided with an air communication passage forming portion for making an intrusion of an ambient air into an inner portion of the bag's main body, at a time of pouring contents from the pouring port formed in the bag's main body.

6. The method of preparing a self-supporting bag according to claim 5, wherein a pouring port forming portion and the air communication passage forming portion are arranged in parallel in the bag's main body, and the pouring port and an air communication passage are formed in parallel.

7. The method of preparing a self-supporting bag according to claim 5, wherein a hanging hole forming portion is provided in the bag's main body, and an air communication passage forming portion is provided between an upper edge portion of the bag's main body and the hanging hole forming portion.

8. The method of preparing a self-supporting bag according to claim 5, wherein the air communication passage forming portion forms an air communication passage, and a communication port communicating an intermediate portion of the air communication passage with an inner portion of the bag's main body.

9. The method of preparing a self-supporting bag according to claim 1, further comprising:

unfolding the bag from the folded state to an unfolded state; and after the unfolding, filling the bag's main body with at least one of a surface active agent or a solvent as a component.

10. The method of preparing a self-supporting bag according to claim 1, wherein the body portion includes two side surfaces and the folding the main body includes folding each of the two side surfaces into two toward an outer side of the body portion so as to fold the body portion in parallel to the bottom portion.

11. The method of preparing a self-supporting bag according to claim 1, wherein the body portion includes two side surfaces and the folding the main body includes folding each of the two side surfaces into two toward an inner side of the body portion so as to fold the body portion in parallel to the bottom portion.

12. The method of preparing a self-supporting bag according to claim 1, wherein the folding the folded self-supporting bag includes standing up both of the side portions of the body portion and the bottom portion in the width direction such that the side portions extend in a direction perpendicular to a central portion of the main body.

13. The method of preparing a self-supporting bag according to claim 1, wherein the body portion includes the front surface and a back surface and the front surface is attached via fusion bonding to the back surface along a top edge of the main body to form a charging portion, and the method further comprises:

opening the charging portion;

filling the self-supporting bag with a component via the charging portion; and after the filling, sealing the charging portion via heat sealing or ultrasonic sealing.

14. The method of preparing a self-supporting bag according to claim 13, further comprising:

pouring the component from the self-supporting bag via a pouring port that is separate from the charging portion.

15. The method of preparing a self-supporting bag according to claim 4, wherein the maintaining means includes at least one convex portion on the body portion and at least one concave portion on the body portion to be engaged and disengaged with the convex portion.

16. The method of preparing a self-supporting bag according to claim 4, wherein the maintaining means includes at least one convex portion on the bottom portion and at least one concave portion on the bottom portion to be engaged and disengaged with the convex portion.

17. The method of preparing a self-supporting bag according to claim 4, wherein the maintaining means includes a hot melt on the bottom portion and the hot melt adheres a first side of the bottom portion to a second side of the bottom portion.

18. A method of preparing a self-supporting bag, comprising:

molding a main body of the self-supporting bag, including a body portion and a bottom portion;

folding the main body of the self-supporting bag, including the body portion and the bottom portion, such that the bottom portion is parallel to the body portion and the self-supporting bag is flat; and folding the folded self-supporting bag by standing up both side portions of the body portion and the bottom portion in a width direction while center portions of the body portion and the bottom portion remain flat such that the support bag is L-shaped on both of the side portions to maintain the self-supporting bag in a folded state, wherein the body portion includes a front surface such that, when the bag is folded by standing up both side portions of the body portion, a left side of the front surface faces a right side of the front surface with a center portion of the front surface located between the left side and the right side.

* * * * *